US008261848B2

(12) United States Patent
Aoki

(10) Patent No.: US 8,261,848 B2
(45) Date of Patent: Sep. 11, 2012

(54) DRILLING APPARATUS

(75) Inventor: Katsutoshi Aoki, Tama (JP)

(73) Assignee: EMS Co., Ltd., Tokyo (JP)

( * ) Notice: Subject to any disclaimer, the term of this patent is extended or adjusted under 35 U.S.C. 154(b) by 82 days.

(21) Appl. No.: 12/740,174

(22) PCT Filed: Nov. 5, 2007

(86) PCT No.: PCT/JP2007/001205

§ 371 (c)(1),
(2), (4) Date: Apr. 28, 2010

(87) PCT Pub. No.: WO2009/057184

PCT Pub. Date: May 7, 2009

(65) Prior Publication Data

US 2010/0252289 A1 Oct. 7, 2010

(30) Foreign Application Priority Data

Oct. 30, 2007 (JP) ..... 2007-281679

(51) Int. Cl.
*E21B 6/04* (2006.01)

(52) U.S. Cl. ..... 173/103; 173/101; 173/102

(58) Field of Classification Search ..... 173/53, 173/103, 105, 203; 175/62
See application file for complete search history.

(56) References Cited

U.S. PATENT DOCUMENTS 2,317,158 A * 4/1943 Westover ..... 74/55
5,289,887 A * 3/1994 Puttmann ..... 175/61

FOREIGN PATENT DOCUMENTS

| | | | |
|---|---|---|---|
| JP | 2005-023551 | | 1/2005 |
| JP | 2006-219940 | | 8/2006 |
| JP | 2006214094 | A * | 8/2006 |
| JP | 2007-239323 | | 9/2007 |
| JP | 2007239323 | A * | 9/2007 |

* cited by examiner

*Primary Examiner* — Rinaldi Rada
*Assistant Examiner* — Nathaniel Chukwurah
(74) *Attorney, Agent, or Firm* — McGlew and Tuttle, P.C.

(57) ABSTRACT

A plurality of weight hammers (7,8) are provided, and each of the plurality of weight hammers has a shape for substantially evenly applying a hammering force with respect to a surface to be hammered of an object to be hammered (11), about a center line of the object to be hammered. Rotors (9, 10) for driving the weight hammers (7,8) are provided to the same rotating shaft (22) in such a positional relation that an engagement claw (9*a*) of one rotor (9) engages and drives one weight hammer (7), and, when engagement of the weight hammer (7) is released, an engagement claw (10*a*) of another rotor (10) in driving engages another weight hammer (8). The rotors are driven by the same driving means (26).

6 Claims, 6 Drawing Sheets

DRILLING APPARATUS

TECHNICAL FIELD

The present invention relates to a drilling apparatus which includes weight hammers provided with compression springs for biasing the weight hammers, respectively, and which hammers an object to be hammered (shank rod or hammer sub) with a hammering force obtained by adding a biasing force of the compression springs to a hammering force generated upon falling of each of the weight hammers, to thereby perform drilling with respect to the object to be hammered.

BACKGROUND ART

Conventionally, there has been provided a drilling apparatus which includes a weight hammer provided with a compression spring for biasing the weight hammer, and which hammers an object to be hammered with a hammering force generated upon falling of the weight hammer. According to this apparatus, a hammering force obtained by adding a biasing force of the compression spring to the gravity of the weight hammer is generated. Therefore, even if a falling distance of the weight hammer is short, a large hammering force can be obtained.

The inventor of the present invention has provided, as such drilling apparatus, the following drilling apparatus (for example, see Patent Document 1). Specifically, the drilling apparatus includes: a weight hammer provided to be slidable; a compression spring for applying the biasing force to the weight hammer; rotors each provided with an engagement claw which engages, through rotation thereof, the weight hammer to cause the weight hammer to move from an original position to a direction of increasing the biasing force of the compression spring, and which releases the engagement of the weight hammer at a predetermined position. In the drilling apparatus, through rotation of the rotors, the engagement claw engages the weight hammer to cause the weight hammer to move to the direction of increasing the biasing force of the compression spring, and releases the engagement of the weight hammer at the predetermined position to cause the weight hammer to move to a direction of the original position with the gravity of the weight hammer and the biasing force of the compression spring, and thus the weight hammer hammers an object to be hammered (shank rod) with the hammering force obtained by adding the biasing force of the compression spring to the gravity of the weight hammer.

The drilling apparatus has a structure in which the weight hammer is lifted up from a lower side thereof by the rotors and is caused to fall. Therefore, the engagement portions of the rotors engage the weight hammer to lift up the weight hammer from the lower side thereof. When the engagement portions pass through a top dead point, the engagement portions are detached from the weight hammer and then the weight hammer is caused to fall. In this case, driving means (for example, motor) of the rotors receives a large load when the weight hammer is engaged and lifted up from the lower side thereof. Further, a phenomenon where, when the weight hammer is detached from the engagement portions, the above-mentioned load is eliminated in an instant repeatedly occurs, and an inertial force of the rotors, which is generated when the above-mentioned load is eliminated in an instant, is repeatedly applied to the driving means. Therefore, the driving means is adversely affected, and durability of the driving means is decreased.

Further, the drilling apparatus has a structure in which, by rotating the rotors, the engagement portions of the rotors engage the weight hammer to lift up the same from the lower side thereof and the engagement portions are detached from the weight hammer in a vicinity of the top dead point and then the weight hammer is caused to fall, to thereby hammer the object to be hammered (shank rod). Therefore, the number of times of hammering per a unit time can not be sufficiently increased. For example, in a case where one engagement portion is provided to the rotors, the weight hammer performs hammering one time for one revolution of the rotors. In a case where two engagement portions are provided to the rotors at 180° intervals, when the rotors semi-rotates, the weight hammer performs hammering one time (hammering two times per one revolution). In this manner, the number of times of hammering per a unit time is determined depending on the number of engagement portions to be provided to the rotors and rotating speed of the rotors. In the conventional structure, there are naturally limits of the number of engagement portions to be provided to the rotors and also rotating speed of the rotors. Therefore, there is also a limit of increasing the number of times of hammering per a unit time, and hence the number of times of hammering per a unit time can not be sufficiently increased.

In this regard, the inventor of the present invention has provided the following drilling apparatus in Patent Document 2. Specifically, in the drilling apparatus, a plurality of weight hammers are provided. The rotors for driving the weight hammers are provided correspondingly to the weight hammers, respectively. The rotors are provided in such a positional relation that the engagement claw of one rotor engages and drives one weight hammer, and, when the engagement of the weight hammer is released, the engagement claw of another rotor in driving engages another weight hammer. The rotors are driven by the same driving means.

With this, each of the rotors is provided in such a positional relation that the engagement claw of the one rotor engages and drives the weight hammer, and, when the engagement of the weight hammer is released, the engagement claw of the another rotor in driving engages the another weight hammer. The rotors are driven by the same driving means.

Therefore, even in a case where the one rotor is driven to engage and move the one weight hammer and the weight hammer is detached from the engagement claw of the one rotor at a predetermined position, the engagement claw of the another rotor engages the another weight hammer. Therefore, the driving means of the rotors receive always a certain load of causing the weight hammer to move (drive). Thus, without applying an excess load due to rapid change of load to the driving means (for example, motor), the durability of drilling apparatus is improved.

Further, the plurality of weight hammers are provided, and hence it is possible to greatly increase the number of times of hammering per a unit time.

Patent Document 1: JP 2005-023551 A

Patent Document 2: JP 2007-239323 A

DISCLOSURE OF THE INVENTION

Problems to be Solved by the Invention

However, the conventional drilling apparatus described above has a structure in which each of the weight hammers hammers an upper surface of a shank rod as the object to be hammered, for example, in such a manner that the weight hammers hammer two right and left separate regions alternately and independently. Therefore, the hammering force is unbalanced with respect to the shank rod, and hence there is a disadvantage in that it is difficult to transmit the hammering force to the shank rod in an axial direction thereof precisely and efficiently.

For example, in a case where two weight hammers are provided, the two weight hammers hammer the upper surface of the shank rod in such a manner that the weight hammers hammer two right and left separate regions alternately and independently. Therefore, there is a disadvantage in that an axial force effective for drilling is not effectively transmitted to a rod to be drilled from the shank rod.

The present invention has been made to solve the conventional problems described above, it is an object of the present invention to obtain a drilling apparatus capable of inhibiting each of the weight hammers from hammering a position in the upper surface of the shank rod in a concentrating manner, and evenly applying the hammering force around the center line of the shank rod, to thereby efficiently hammer and thrust the shank rod in the axial direction thereof.

Means for Solving the Problems

In order to achieve the above-mentioned object, according to the present invention, there is provided a drilling apparatus, including a hammering apparatus built-in the drilling apparatus, the hammering apparatus which includes a drill head including: a weight hammer provided to be slidable; a compression spring for applying a biasing force to the weight hammer; and a rotor provided with an engagement claw that engages, through rotation thereof, the weight hammer to cause the weight hammer to move from an original position thereof to a direction of increasing the biasing force of the compression spring, and that releases the engagement of the weight hammer at a predetermined position, in which through the rotation of the rotor, the engagement claw engages the weight hammer to cause the weight hammer to move to the direction of increasing the biasing force of the compression spring, and releases the engagement of the weight hammer at the predetermined position to cause the weight hammer to move to a direction of the original position with the gravity of the weight hammer and the biasing force of the compression spring, and thus the weight hammer hammers an object to be hammered with a hammering force obtained by adding the biasing force of the compression spring to the gravity of the weight hammer, in which: the weight hammer includes a plurality of weight hammers; each of the plurality of weight hammers has a shape for alternately and substantially evenly applying the hammering force with respect to a surface to be hammered of the object to be hammered, in a region about a center line of the object to be hammered; the rotor includes a plurality of rotors; the plurality of rotors for driving the plurality of weight hammers are provided correspondingly to the plurality of weight hammers, respectively; the plurality of rotors are provided to the same rotating shaft in such a positional relation that an engagement claw of one of the plurality of rotors engages and drives one of the plurality of weight hammers, and, when the engagement of the one of the plurality of weight hammers is released, an engagement claw of another of the plurality of rotors in driving engages another of the plurality of weight hammers; and the plurality of rotors are driven by the same driving means.

With this structure, any weight hammer is capable of applying evenly the hammering force around the center line in the upper surface of the shank rod, and it is possible to efficiently transmit the hammering force to an axial direction of the shank rod. Thus, it is possible to efficiently apply the hammering force to the rod to be drilled in an axial direction of the rod to be drilled.

Further, in the above-mentioned invention, the drilling apparatus is characterized in that each of the plurality of weight hammers has a shape in which, at least in a lower end portion thereof, a shaft portion formed in the another of the plurality of weight hammers passes through a cylindrical portion formed in the one of the plurality of weight hammers to be slidable therethrough.

With this structure, the one of the plurality of weight hammers hammers a predetermined region in a vicinity of a center portion in the upper surface of the shank rod, and the another of the plurality of weight hammers hammers an annular region adjacent to a vicinity of the center line. Thus, a vertical and even hammering force acts always in an entire region of the upper surface of the shank rod. As a result, the hammering force received by the shank rod can be transmitted to an entire of the rod to be drilled without unbalance, and hence it is possible to improve efficiency of drilling.

Effects of the Invention

According to the present invention, even in a case where the plurality of weight hammers are provided, each of the weight hammers is inhibited from hammering a position in the upper surface of the shank rod in a concentrating manner, and it is possible to evenly apply the hammering force around the center line of the upper surface of the shank rod, to thereby efficiently hammer and thrust the shank rod in the vertical direction while decreasing loss of the hammering force with respect to the shank rod and the rod to be drilled.

BEST MODE FOR CARRYING OUT THE INVENTION

Hereinafter, a drilling apparatus according to an embodiment of the present invention is described in detail with reference to the drawings.

FIG. 1 is a side view schematically illustrating an entire of the drilling apparatus according to this embodiment. FIG. 2 is a perspective view illustrating main parts of the drilling apparatus according to this embodiment. FIG. 3 is an exploded perspective view illustrating the main parts of the drilling apparatus in this embodiment. FIGS. 4(*a*) and 4 (*b*) are longitudinal sectional views illustrating the main parts of the drilling apparatus in this embodiment before and after operation. FIG. 5 is a sectional view of a drill head, which illustrates an example of the present invention. FIG. 6 is a central longitudinal sectional view of the drill head illustrated in FIG. 5.

In the drilling apparatus, as illustrated in FIG. 1, a leader 1 is provided upright to a base machine B to be movable up and down, and a drill head 2 is provided to the leader 1 to be slidable. Typically, the base machine B is provided with a power unit 3, a control box 4, a boom hydraulic cylinder 5, a slide cylinder 6, and the like. The leader 1 is provided upright to the base machine B through cylinders such as the boom hydraulic cylinder 5, the slide cylinder 6, and the like to be movable up and down.

The leader 1 includes a slide case 1A provided to be slidable along the leader. The slide case 1A is fixedly provided with the drill head 2 and is caused to advance and retract along the leader 1 through driving means. The driving means may include well-known means. In this embodiment, the cylinder 6 is employed, and a leading end of a cylinder rod of the cylinder 6 is coupled to the slide case 1A.

In the drill head 2, as illustrated in FIG. 2, there are installed a pair of weight hammers 7, 8 both provided to be slidable to a vertical direction, rotors 9, 10 for alternately lifting up the weight hammers 7, 8 and causing the weight hammers 7, 8 to fall, a shank rod 11 which is provided on a falling line of the weight hammers 7, 8 and is hammered upon falling of the weight hammers 7, 8, compression springs 13 which are received in spring-inserting holes 12 provided in the weight hammers 7, 8, for biasing the weight hammers 7, 8 to a hammering direction of the shank rod 11, a power transmission mechanism of a motor 24, which is described later, for rotating the shank rod 11, and the like.

The slide case 1A is a rectangular parallelepiped box-shape, and the leading end of the cylinder rod of the cylinder 6 as the driving means is fixed to the slide case 1A.

The weight hammer 7 includes: a semi-circular column portion 14 located in an upper part thereof; a cylindrical portion 15 located in a lower part thereof, which has a smaller diameter than that of the semi-circular column portion 14; and a rotor-receiving portion 16 for coupling the cylindrical portion 15 and the semi-circular column portion 14. In a section including the semi-circular column portion 14, and the rotor-receiving portion 16 located upper than the cylindrical portion 15, there is provided a semi-circular cutout 17 which has the same diameter as an inner periphery of the cylindrical portion 15 and is continuous with the inner periphery so as to extend over an entire of the semi-circular column portion 14 and the rotor-receiving portion 16.

Further, the weight hammer 8 includes: a semi-circular column portion 18 located in an upper part thereof; a circular column portion (shaft portion) 19 which is located in a lower part thereof and has a smaller diameter than that of the semi-circular column portion 18; and a rotor-receiving portion 20 for coupling the semi-circular column portion 18 and the circular column portion 19. On a side of an inner surface of the rotor-receiving portion 20, there is protrudingly provided a semi-circular column portion 21 having the same diameter as that of the circular column portion 19 so as to be continuous with the circular column portion 19. The semi-circular column portion 21 is integrally provided on the side of the inner surface of the rotor-receiving portion 20.

The weight hammers 7, 8 have the structures different from each other as described above. The circular column portion 19 and the semi-circular column portion 21 of the weight hammer 8 are inserted and fitted into the cylindrical portion 15 and the semi-circular cutout 17 of the weight hammer 7. The circular column portion 19 and the semi-circular column portion 21 of the weight hammer 8 are capable of sliding in an axial direction thereof in inserted portion and fitted portion thereof.

Thus, when the weight hammers 7, 8 are overlaid to each other on flat perpendicular surfaces thereof through insertion and fitting as illustrated in FIG. 2 and FIG. 4, a lower end surface of the cylindrical portion 15 is opposed to the shank rod 11 so that the cylindrical portion 15 is allowed to evenly hammer a predetermined annular region about a center line on an upper surface of the shank rod 11 (FIG. 4 (*a*)), and a lower surface of the circular column portion 19 is opposed to the shank rod 11 so that the circular column portion 19 is allowed to evenly hammer a predetermined circular region about the center line on the upper surface of the shank rod 11 (FIG. 4 (*b*)).

The rotor-receiving portions 16, 20 include protrusions 16*a*, 20*a*, respectively. In positions opposed to the protrusions 16*a*, 20*a*, there are arranged two rotors 9, 10. The two rotors 9, are fixed in a direction orthogonal to one rotating shaft 22. The rotors 9, 10 form a propeller-shape as a whole. Each of the engagement claws 9*a*, 10*a* of the leading ends is rotated to lift up each of the protrusions 16*a*, 20*a* of the rotor-receiving portions 16, 20 from below, and move away from each of the protrusions 16*a*, 20*a* at a top dead position of each of the rotor-receiving portions 16, 20.

Thus, it is possible that the rotors 9, 10 are rotated to engage the protrusions 16*a*, 20*a* of the rotor-receiving portions 16, 20, and cause the protrusions 16*a*, 20*a* to move upwardly to a direction of increasing the biasing force of each of the compression springs 13, and, through releasing the engagement of the protrusions 16*a*, 20*a* at a predetermined position (top dead position), each of the protrusions 16*a*, 20*a* is lowered to an original position thereof. As a result, with a hammering force obtained by adding the gravity of the weight hammers 7, 8 to a repulsive force (biasing force) of the compression springs 13, it is possible to hammer a head of the shank rod 11.

In this case, the hammering force by each of the weight hammers 7, 8 acts, as illustrated in FIGS. 4 (*a*) and (*b*), evenly on each region about the center line of the shank rod 11. Thus, in comparison with the conventional method in which the hammering force is applied while concentrating to one side of the center line of the shank rod 11, efficient use of the hammering force in the axial direction for drilling is achieved. That is, the hammering force is efficiently applied to the rod to be drilled.

Thus, when the motor 26 is driven, one of the engagement claws 9*a* of one rotor 9 engages one weight hammer 7, as illustrated in FIG. 2, and causes the one weight hammer 7 to move to the direction of increasing the biasing force of the compression springs 13, as illustrated in FIG. 2 and FIGS. 4 (*a*) and (*b*). When engagement is released in a predetermined position (for example, in a vicinity of the top dead point of the weight hammer 7), the engagement claw 10*a* of the another rotating rotor 10 engages the another weight hammer 8 and causes the same to move to the direction of increasing the biasing force of the compression springs 13.

The above-mentioned operation is alternately performed by the one rotor 9 and the another rotor 10 through their rotation. Therefore, the one weight hammer 7 and the another weight hammer 8 alternately make perform movement to the direction of increasing the biasing force of the compression springs 13 and movement to the hammering direction. Further, the rotors 9, 10 are arranged in a relation in which the rotors 9, 10 are orthogonal to each other, and hence, when the one weight hammer 7 performs hammering twice for one revolution of the one rotor 9, and the another weight hammer 8 also performs hammering twice for one revolution of the another rotor 10. The one rotor 9 and the another rotor 10 are fixedly provided to the rotating shaft 22, and both of the weight hammers 7, 8 hammer the same shank rod (object to be hammered) 11. Thus, both of the weight hammers 7, 8 hammer the shank rod 11 four times for one revolution of the rotating shaft 22. That is, for one revolution of the rotating shaft 22 through the motor (driving means) 26, it is possible to hammer the rod to be drilled four times.

In this manner, load of engagement anyone of the weight hammers 7, 8 is always applied to the driving means (motor) 26, and hence repeated rapid change of load is not be applied to the driving means. Further, one revolution of the rotating shaft 22 (rotors 9, 10) can lead to four-times hammering, and hence the number of times of hammering can be also substantially increased.

EXAMPLE 1

Next, the present invention is described further in detail with reference to an example. FIG. 5 is a sectional view of the drill head 2, which illustrates the example of the present invention, and FIG. 6 is a central longitudinal sectional view of FIG. 5. The same components as those of the above-mentioned embodiment are denoted by the same reference symbols and in the following description.

In FIG. 5, the drill head 2 installs: two weight hammers 7, 8 provided in the case 1A to be slidable in upper and lower direction; the compression springs 13 for applying the biasing force to each of the weight hammer 7, 8; the rotors 9, 10 which are provided for the weight hammers 7, 8, respectively, and are rotated to engage the weight hammers 7, 8 and move the weight hammers 7, 8 upwardly from the original position thereof while increasing the biasing force of the compression springs 13, and release the engagement of the weight hammers 7, 8 in the vicinity of the top dead point; the shank rod 11 as the object to be hammered which is hammered with the hammering force obtained by adding the biasing force of each of the compression springs 13 to the gravity of the weight hammers 7, 8 when the rotors 9, 10 are rotated to engage the weight hammers 7, 8 and move the weight hammers 7, 8 upwardly while increasing the biasing force of each of the compression springs 13, and release the engagement of the weight hammers 7, 8 in the vicinity of the top dead point to cause the weight hammers 7, 8 to fall to the direction of the original position; the power transmission mechanism 25 of the motor 24 for rotating the shank rod 11; and the like. That is, the drill head 2 installs: the weight hammers 7, 8; the shank rod 11; and the power transmission mechanism 25 of the motor 24 for rotating the shank rod 11, and the drill head 2 is capable of applying the hammering force and a rotational force.

The two weight hammers 7, 8 are provided in the case 1A to be movable up and down and to be arranged in parallel to each other. In the weight hammers 7, 8, the compression springs 13 for biasing the weight hammers 7, 8 to a direction of the shank rod 11 as the object to be hammered are provided, respectively. In this example, each of the weight hammers 7, 8 includes in an upper part thereof the spring-inserting holes 12. The compression springs 13 are, on a lower side thereof, fitted into the spring-inserting holes 12 of the weight hammers 7, 8, and upper ends thereof are provided to abut against a top plate 23 of the case 1A. The biasing force of the compression springs 13 acts on the weight hammers 7, 8 toward the shank rod 11.

In this example, three compression springs 13 are provided in each of the weight hammers 7, 8. Each of the weight hammers 7, 8 hammers the shank rod 11, to thereby apply the hammering force to the rod to be drilled which is coupled to the shank rod 11. Thus, in a case where each of the compression springs 13 is provided, the biasing force of the compression springs 13 is added to the hammering force generated upon free falling of the weight hammers 7, 8.

It is preferred that the weight hammers 7, 8 be incapable of rotating in the case 1A and be fixed to be slidable in the upper and lower direction so that, when the weight hammers 7, 8 are lifted up and caused to fall, the weight hammers 7, 8 do not rotate. In this example, the case 1A has a non-circular cross-sectional surface (rectangular shape), and the weight hammers 7, 8 have a non-circular cross-sectional shape portion corresponding to the non-circular cross-sectional surface of the case 23.

The weight hammers 7, 8 are, through rotation of the rotors 9, 10, moved upwardly while compressing the compression springs 13, and then caused to fall. That is, the rotors 9, 10 are rotated to engage the weight hammers 7, 8 and move the weight hammers 7, 8 upwardly from the original position thereof while compressing the compression springs 13, and release the engagement of the weight hammers 7, 8 in the vicinity of the top dead point. The weight hammers 7, 8 are, through rotation of the rotors 9, 10, moved upwardly from the original position thereof while compressing the compression springs 13, and the engagement of the weight hammers 7, 8 is released in the vicinity of the top dead point. Thus, the weight hammers 7, 8 hammer the shank rod 11 with the hammering force obtained by adding the biasing force of the compression springs 13 to the gravity of the weight hammers 7, 8, which is generated upon free falling thereof.

The rotors 9, 10 are fixedly provided to the same rotating shaft 22 of the same motor 26. The rotors 9, 10 are provided with the engagement claws 9*a*, 10*a* at 180° intervals, respectively. The engagement claws 9*a*, 10*a* are fixedly provided to be arranged in parallel to each other in such a relation in which a line linking the engagement claws 9*a*, 9*a* of one rotor 9 to each other is orthogonal to a line linking the engagement claws 10*a*, 10*a* of the another rotor 10 to each other.

Thus, when the rotors 9, 10 are rotated by the motor 26, the engagement claw 9*a* of the one rotor 9 engages the one weight hammer 7, and moves the one weight hammer 7 upwardly while increasing the biasing force of the compression springs 13, and, when engagement is released in the vicinity of the top dead point, the engagement claw 10*a* of the another rotating rotor 10 engages the another weight hammer 8, and moves the another weight hammer 8 upwardly while increasing the biasing force of the compression springs 13.

The above-mentioned operation is alternately performed by the one rotor 9 and the another rotor 10 through their rotation, and hence the one weight hammer 7 and the another weight hammer 8 perform alternately upward movement and hammering by falling. The above-mentioned alternate hammering by the one weight hammer 7 and the another weight hammer 8 is performed twice for one revolution of the rotors 9, 10, respectively, because the rotors 9, 10 are provided with the engagement claws 9*a*, 10*a* at 180° intervals, respectively. Thus, the one rotor 9 and the another rotor 10 are fixedly provided to the same rotating shaft 22, and both of the weight hammers 7, 8 hammer the same shank rod 11. Therefore, for one revolution of both of the rotors 9, 10 (one revolution of rotating shaft 22), the shank rod 11 can be hammered four times.

Note that, in a case where the rotors 9, 10 provided to the rotating shaft 22 are provided in such a manner that the rotors 9, 10 hold the weight hammers 7, 8 therebetween to bring the weight hammers 7, 8 in contact with each other, it is possible to prevent the weight hammers 7, 8 from moving away from each other, and to prevent the weight hammers 7, 8 from rotating, which is preferable.

Further, the shank rod 11 is rotatable, and is coupled to the motor 24 through the power transmission mechanism 25 to be rotated. In this example, as illustrated in FIG. 5 http://www6.ipdl.inpit.go.jp/Tokujitu/tjitemdrw.ipdl?N0000=231&N0500=4E_N/;>6=<6<=</// /&N0001=8&N0552=9&N0553=000007 and FIG. 6, in an outer periphery of the shank rod 11, there is provided a spindle gear 27. The spindle gear 27 is splined to the shank rod 11 to be movable relatively to the shank rod 11. A gear 28 coupled to a driving shaft of the motor 24 is meshed with the spindle gear 27. Thus, the shank rod 11 is rotated in such a way that a rotational force generated by driving of the motor 24 is transmitted through the gear 28 and the spindle gear 27 to the shank rod 11.

As described above, according to the drilling apparatus including the drill head 2 of this example, the following action is obtained. When the rod to be drilled is coupled to the shank rod 11, the following forces are transmitted to the rod to be drilled: the hammering force obtained by adding the biasing force of the respective compression springs 13 to the hammering force which is alternately applied by the weight hammers 7, 8 upon free falling of the weight hammers 7, 8; the rotational force generated by the motor 24, a thrust force generated by a chain or a cylinder rotated by a driving source. Thus, according to the drilling apparatus, it is possible to drill the rod to be drilled through applying the hammering force, the rotational force, and the thrust force to the rod to be drilled.

Further, it is possible that driving of the motor 24 is stopped, rotation of the shank rod 11 is stopped, and then, through driving of only the rotors 9, 10 by the motor 26, only the weight hammers 7, 8 are actuated, to thereby apply only the hammering force and the thrust force of the weight hammers 7, 8 to the rod to be drilled. Further, it is possible that driving of the motor 26 is stopped, actuation of the weight hammers 7, 8 is stopped, and then, through driving of the motor 24, only the shank rod 11 is rotated, to thereby apply only the rotational force and the thrust force. The above-mentioned operations can be selectably performed.

In addition, with regard to the rotors 9, 10, the engagement claw 9*a* of the one rotor 9 engages and drives the one weight hammer 7, and, when the engagement of the one weight hammer 7 is released, the engagement claw 10*a* of the another driving rotor 10 engages the another weight hammer 8. In turn, the engagement claw 10*a* of the another rotor 10 engages and drives the another weight hammer 8, and, when the engagement of the another weight hammer 8 is released, the engagement claw 9*a* of the one driving rotor 9 engages the one weight hammer 7. The rotors 9, 10 are fixedly provided to the same rotating shaft 22 of the same motor 26, and each of the weight hammers 7, 8 hammers the same shank rod 11.

Further, in this example, in particular, the two weight hammers 7, 8 are provided. As illustrated in FIGS. 4 (*a*) and (*b*), each of the weight hammers 7, 8 applies alternately and substantially evenly the hammering force with respect to a surface to be hammered of the shank rod 11, in the circular region around the center line and the annular region around the circular region (region not concentrating to one side with respect to the center line).

With this, it is possible to inhibit each of the weight hammers 7, 8 from hammering a position in the upper surface of the shank rod 11 in a concentrating manner, and evenly apply the hammering force around the center line of the shank rod 11, to thereby of hammer and thrust the shank rod 11 and the rod to be drilled in a vertical plane.

Further, a certain load of any one of the driving weight hammers 7, 8 is always applied to the motor 26. Therefore, an excess load due to repeated rapid changes of load is not applied to the motor 26, and hence durability of the motor 26 is improved. Further, as the motor 26, not only a hydraulic motor, but also an air motor and an electric motor may be used.

In addition, the shank rod 11 is alternately hammered by the two weight hammers 7, 8, and further, the weight hammers 7, 8 perform hammering twice for one revolution of the rotors 9, 10, respectively. That is, the shank rod 11 is hammered four times for one revolution of the rotating shaft 22. Thus, the number of times of hammering per a unit time can be substantially increased. It is possible to increase the number of times of hammering, and hence it is possible to substantially improve efficiency of drilling.

Note that, it is needless to say that the drilling apparatus may be broadly applied to a base machine mounting-type or a backhoe type or the like in addition to a crawler type of FIG. 1.

DESCRIPTION OF SYMBOLS

Figure 1:
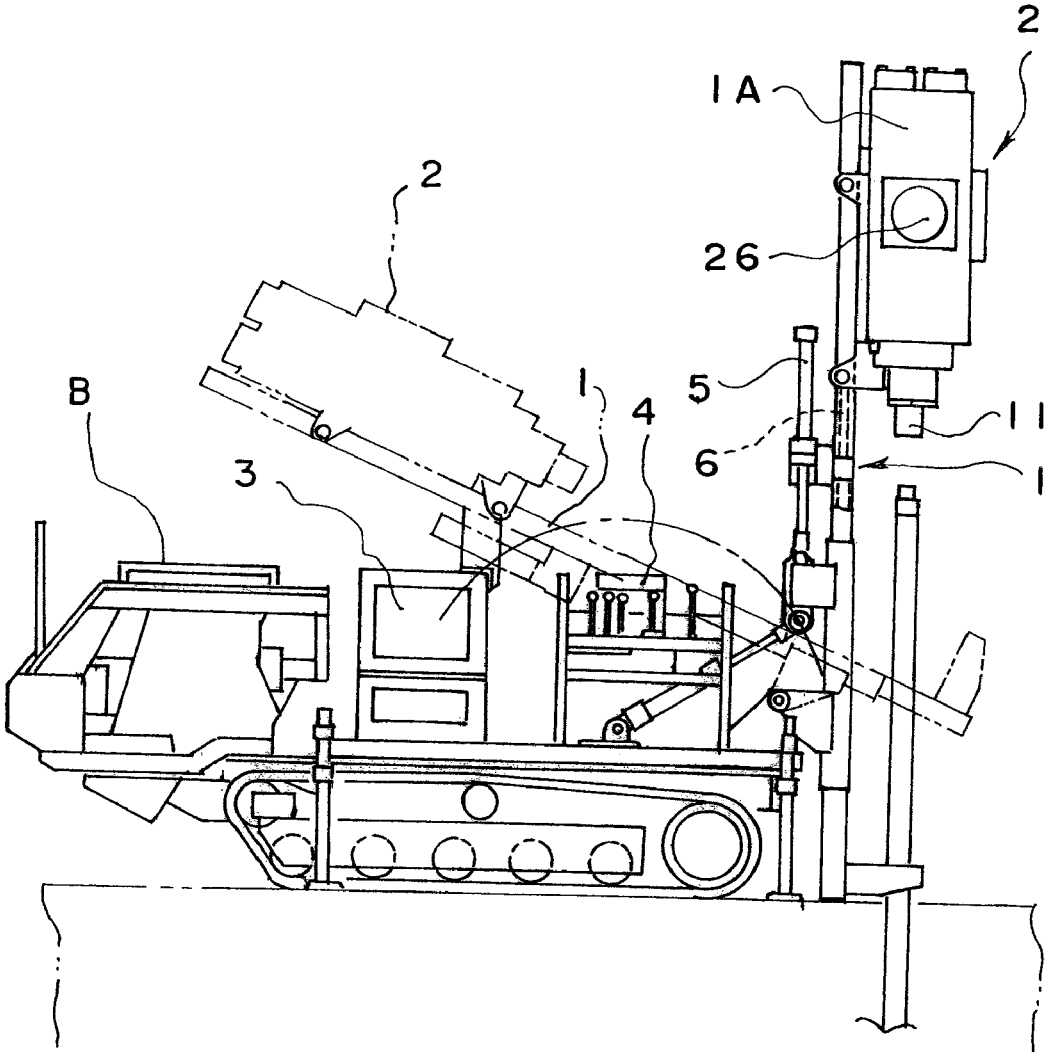
FIG. 1 A side view of a drilling apparatus, which illustrates an embodiment of the present invention.
Figure 2:
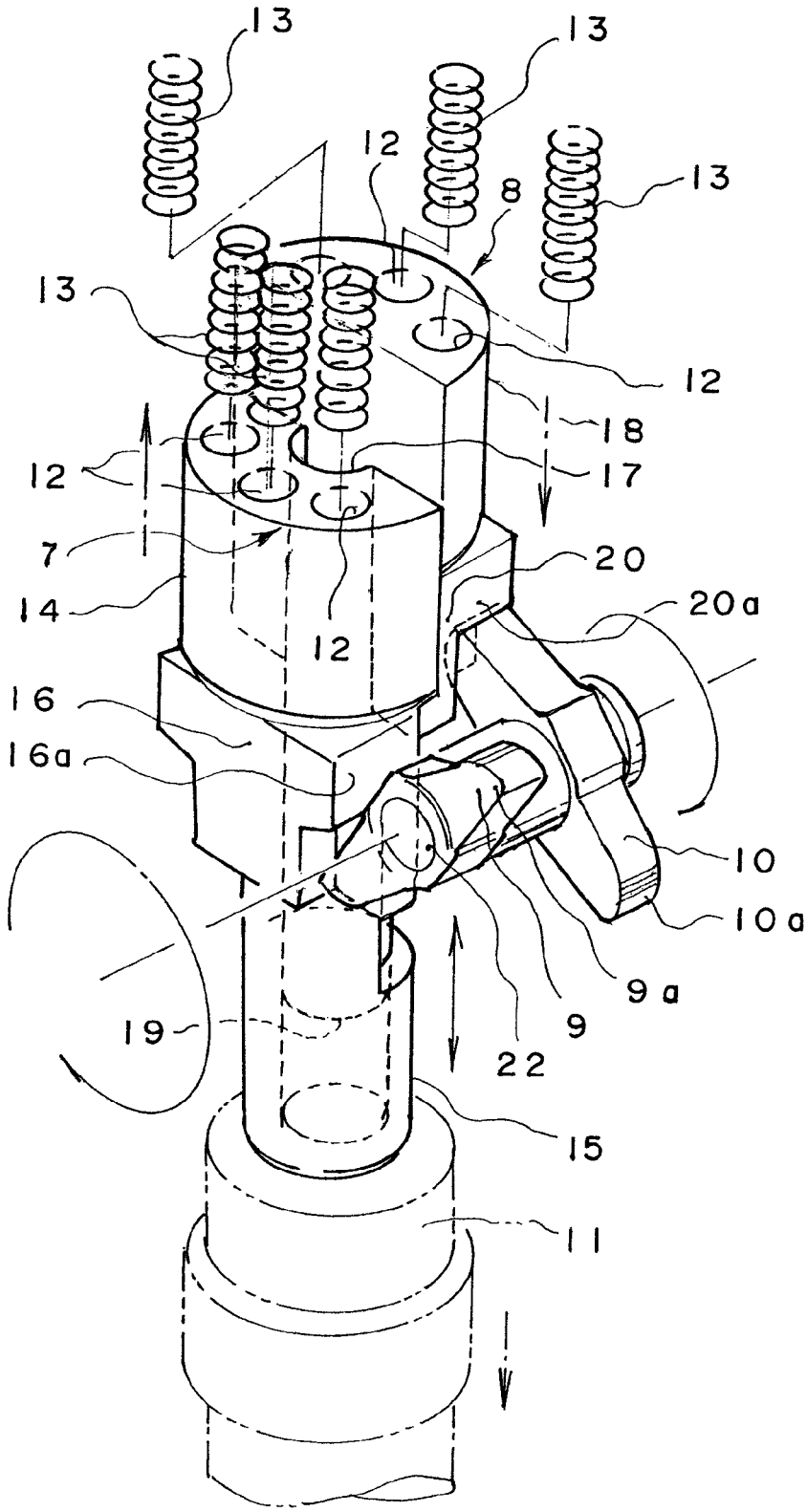
FIG. 2 A perspective view of main parts, which illustrates the embodiment of the present invention.
Figure 3:
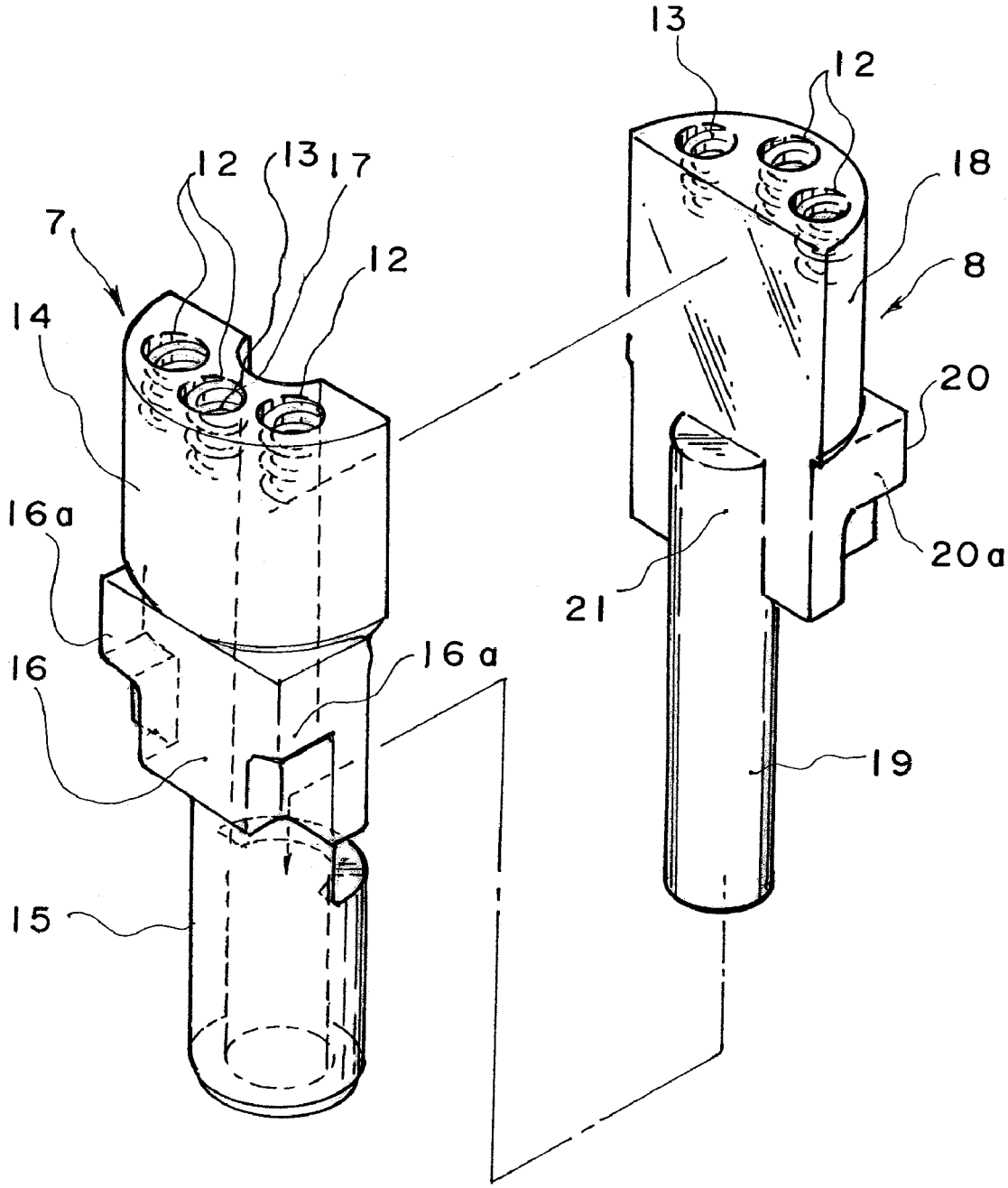
FIG. 3 An exploded perspective view of the main parts, which illustrates the embodiment of the present invention.
Figure 4:
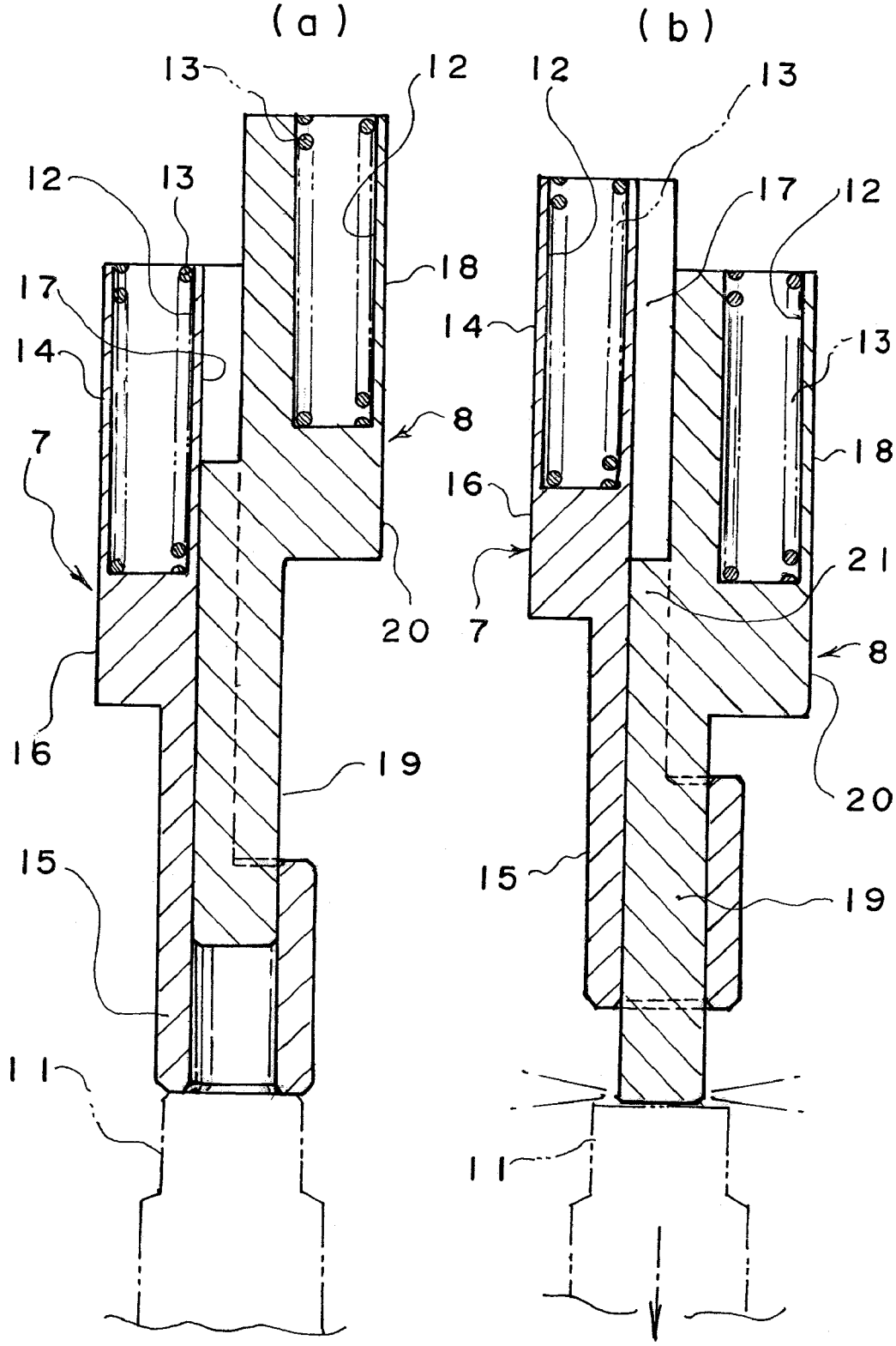
FIG. 4 A longitudinal sectional view illustrating states (a) and (b) before and after operation of the main parts, which illustrates the embodiment of the present invention.
Figure 5:
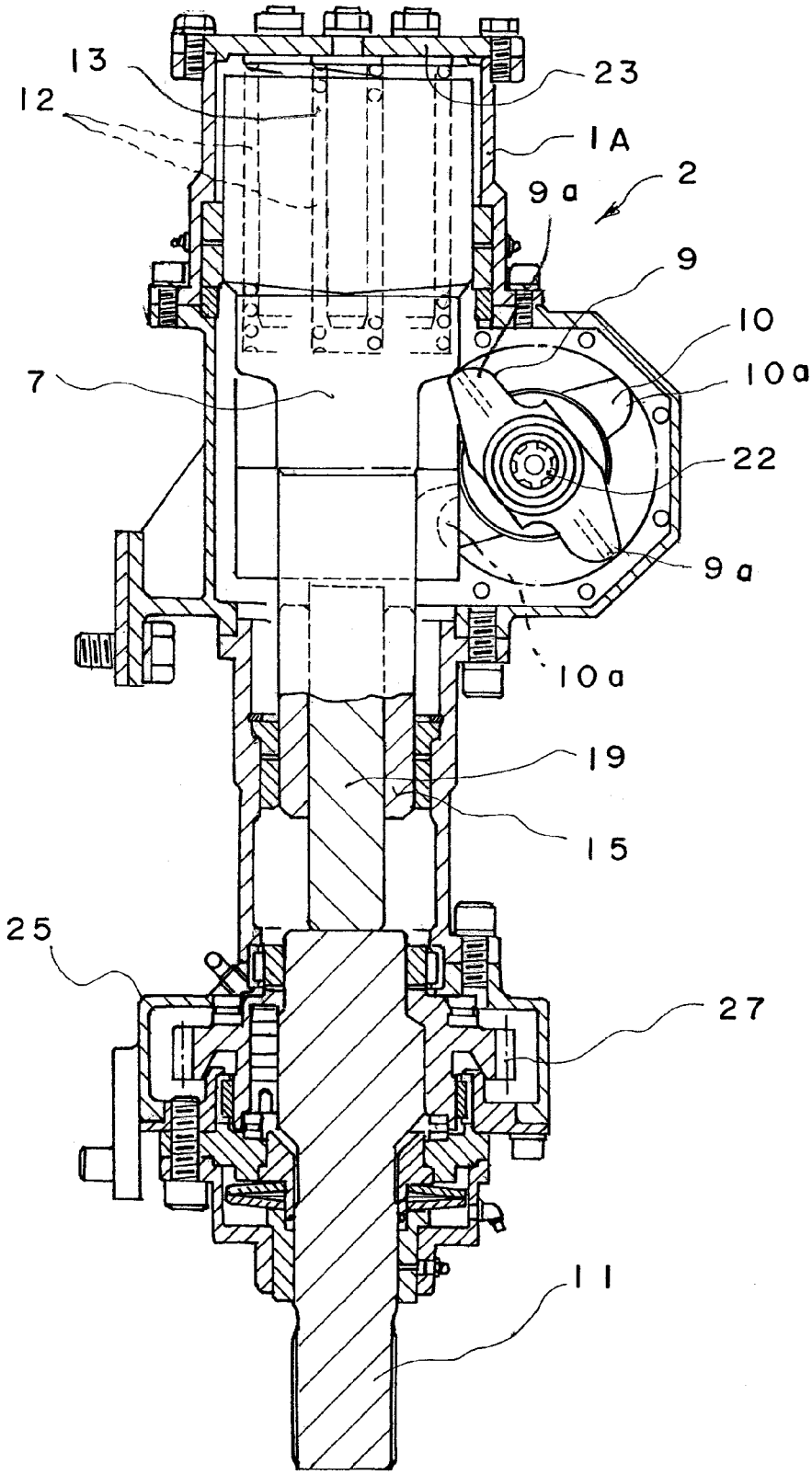
FIG. 5 A sectional view of a drill head, which illustrates an example of the present invention.
Figure 6:
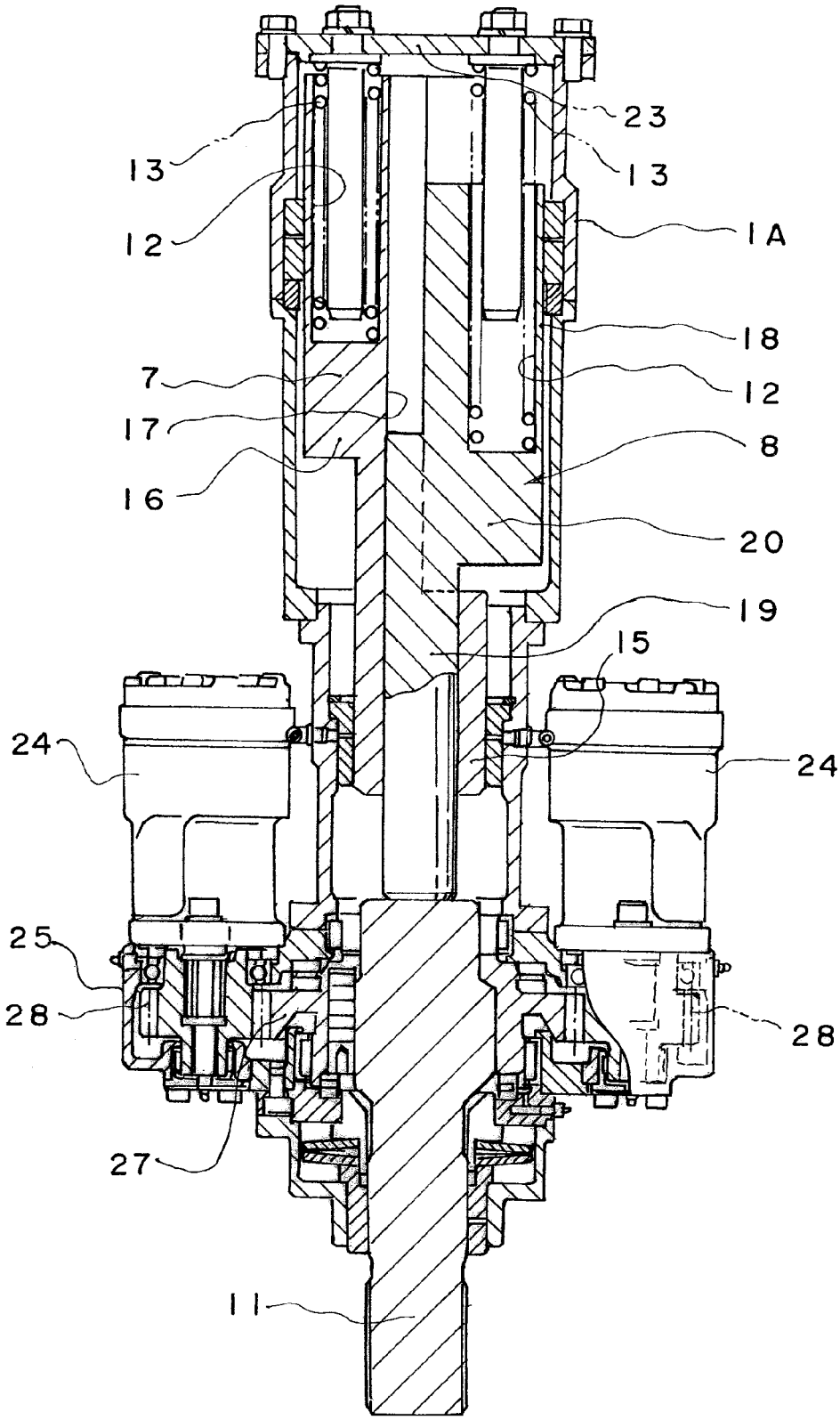
FIG. 6 A central longitudinal sectional view of FIG. 5, which illustrates the example of the present invention.

1 leader
1A slide case
2 drill head
7, 8 weight hammer
9, 10 rotor
9*a*, 10 an engagement claw
11 shank rod
13 compression spring
14, 18 semi-circular column portion
15 cylindrical portion
16, 20 rotor-receiving portion
17 semi-circular cutout
19 circular column portion
21 semi-circular column portion
22 rotating shaft
26 motor (driving means)

The invention claimed is:

1. A drilling apparatus, comprising:

a hammering apparatus built-in the drilling apparatus, said hammering apparatus comprising a drill head, said drill head comprising:

a weight hammer;

a compression spring for applying a biasing force to the weight hammer; and a rotor comprising an engagement claw, said engagement claw engaging, through rotation thereof, the weight hammer to such that the weight hammer moves from an original position in a direction of increasing the biasing force of the compression spring, and said engagement claw releases weight hammer at a predetermined position such that the weight hammer moves in a direction of the original position with the gravity of the weight hammer and the biasing force of the compression spring, wherein the weight hammer hammers an object to be hammered with a hammering force obtained by adding the biasing force of the compression spring to the gravity of the weight hammer, said weight hammer comprising a first weight hammer and a second weight hammer, said first weight hammer and said second weight hammer being abutted to each other, each of said first weight hammer and said second weight hammer being slidably movable in a vertical direction, said first weight hammer comprising a semi-circular column portion located in an upper part thereof, a circular column portion located in a lower part thereof and a rotor-receiving portion for coupling said cylindrical portion and said semi-circular column portion, said circular column portion having a diameter that is less than a diameter of said semi-circular column portion, said second weight hammer comprising a second hammer semi-circular column portion located in an upper second hammer part thereof, a second hammer cylindrical portion located in a lower second hammer part thereof and a second hammer rotor-receiving portion for coupling said second hammer cylindrical portion and said second hammer semi-circular column portion, said second hammer cylindrical portion having a diameter that is less than a diameter of said second hammer semi-circular portion, wherein a second hammer semi-circular columnar protrusion is provided on a sliding surface of said second hammer rotor-receiving portion, said semi-circular columnar protrusion having a diameter that is equal to a diameter of said second hammer cylindrical portion, said second hammer cylindrical portion being integrally connected to said second hammer semi-circular columnar protrusion, whereby said second hammer cylindrical portion is continuous with said second hammer semi-circular columnar protrusion, wherein a semi-circular cutout is provided on a sliding surface between said second hammer semi-circular column portion and said rotor-receiving portion of said first weight hammer, said semi-circular cutout having a diameter equal to a diameter of an inner periphery of said circular column portion of said first hammer weight and said semi-circular cutout being continuous with said inner periphery of said circular column portion of said first hammer weight, said second hammer cylindrical portion being inserted into said circular column portion of said first weight hammer, said second hammer semi-circular columnar protrusion being fitted into and abutted on said semi-circular cutout, said circular column portion of said first weight hammer and said second hammer cylindrical portion being arranged on the same center line, said circular column portion of said first weight hammer and said second hammer cylindrical portion being slidable relative to each other in an axial direction, said rotor comprising a plurality of rotors, the plurality of rotors being provided to the same rotating shaft in such a positional relation that said engagement claw of one of the plurality of rotors engages and drives said first weight hammer, and, when engagement of the first weight hammer is released, said engagement claw of another of the plurality of rotors in driving engages said second weight hammer, wherein the plurality of rotors are driven by the same driving means.

2. A drilling apparatus comprising:

a hammering apparatus comprising a first weight hammer and a second weight hammer, said first weight hammer and said second weight hammer being movable relative to one another, said first weight hammer comprising a first hammer semi-circular column portion located in an upper first hammer part thereof, a first hammer cylindrical portion located in a lower first hammer part thereof and a first hammer rotor-receiving portion, said first hammer cylindrical portion comprising an inner cylindrical portion surface, said first hammer cylindrical portion being connected to said first hammer semi-circular column portion via said first hammer rotor-receiving portion, said first hammer cylindrical portion having a first hammer cylindrical portion diameter, said first hammer semi-circular column portion having a first hammer semi-circular column portion diameter, said first hammer cylindrical portion diameter being less than said first hammer semi-circular column portion diameter, at least a portion of said first hammer weight defining at least a portion of a second hammer semi-circular column protrusion receiving space, said inner cylindrical portion surface defining a second hammer cylindrical portion receiving space, said second hammer cylindrical portion receiving space having a second hammer cylindrical portion receiving space diameter, said second hammer semi-circular column protrusion receiving space having a second hammer semi-circular column protrusion receiving space diameter, said second hammer cylindrical portion receiving space diameter being equal to said second hammer semi-circular column protrusion receiving space diameter, said second hammer semicircular column protrusion receiving space being in communication with at least a portion of said second hammer cylindrical receiving space, said second weight hammer comprising a second hammer semi-circular column portion located in an upper second hammer part thereof, a second hammer circular column portion located in a lower second hammer part thereof and a second hammer rotor-receiving portion, said second hammer semi-circular column portion being connected to said second hammer circular column portion via said second hammer rotor-receiving portion, said second hammer circular column portion having a second hammer circular column portion diameter, said second hammer semi-circular column portion having a second hammer semi-circular column portion diameter, said second hammer circular column portion diameter being less than said second hammer semi-circular column portion diameter, said second hammer rotor receiving portion comprising a second hammer semi-circular column protrusion on an inner side thereof, said second hammer semi-circular column protrusion having a semi-circular protrusion diameter, said second hammer circular column portion having a second hammer circular column portion diameter, said second hammer circular column portion diameter being equal to said semi-circular protrusion diameter, said semi-circular column protrusion being integrally connected with said second hammer circular column portion, at least a portion of said second hammer circular column portion being arranged in said second hammer cylindrical portion receiving space, at least a portion of said second hammer semi-circular column protrusion being arranged in said semi-circular column protrusion receiving space.

3. A drilling apparatus in accordance with claim 2, wherein said hammering apparatus further comprises a first rotor and a second rotor, said first rotor comprising a first rotor engagement claw, said second rotor comprising a second rotor engagement claw, said first rotor engagement claw rotor engaging said first weight hammer such that said first weight hammer moves from a first hammer original position to a first hammer raised position, said second rotor engagement claw rotor engaging said second weight hammer such that said second weight hammer moves from an original second weight hammer position to a raised second weight hammer position when said first weight hammer is released via said first rotor engagement claw rotor.

4. A drilling apparatus in accordance with claim 3, wherein said hammer apparatus further comprises a first spring and a second spring, said first weight hammer compressing said first spring with said first weight hammer in said first hammer raised position, said second weight hammer compressing said second spring with said second weight hammer in said second hammer raised position.

5. A drilling apparatus comprising:

a first weight hammer said first weight hammer comprising a first hammer semi-circular column portion located in an upper first hammer part thereof, a first hammer cylindrical portion located in a lower first hammer part thereof and a first hammer rotor-receiving portion, said first hammer cylindrical portion comprising an inner cylindrical portion surface, said first hammer cylindrical portion being connected to said first hammer semi-circular column portion via said first hammer rotor-receiving portion, said first hammer cylindrical portion having a first hammer cylindrical portion diameter, said first hammer semi-circular column portion having a first hammer semi-circular column portion diameter, said first hammer cylindrical portion diameter being less than said first hammer semi-circular column portion diameter, at least a portion of said first hammer weight defining at least a portion of a second hammer semi-circular column protrusion receiving space, said inner cylindrical portion surface defining a second hammer cylindrical portion receiving space, said second hammer cylindrical portion receiving space having a second hammer cylindrical portion receiving space diameter, said second hammer semi-circular column protrusion receiving space having a second hammer semi-circular column protrusion receiving space diameter, said second hammer cylindrical portion receiving space diameter being equal to said second hammer semi-circular column protrusion receiving space diameter, said second hammer semicircular column protrusion receiving space being in communication with at least a portion of said second hammer cylindrical receiving space;

a second weight hammer comprising a second hammer semi-circular column portion located in an upper second hammer part thereof, a second hammer circular column portion located in a lower second hammer part thereof and a second hammer rotor-receiving portion, said second hammer semi-circular column portion being connected to said second hammer circular column portion via said second hammer rotor-receiving portion, said second hammer circular column portion having a second hammer circular column portion diameter, said second hammer semi-circular column portion having a second hammer semi-circular column portion diameter, said second hammer circular column portion diameter being less than said second hammer semi-circular column portion diameter, said second hammer rotor receiving portion comprising a second hammer semi-circular column protrusion on an inner side thereof, said second hammer semi-circular column protrusion having a semi-circular protrusion diameter, said second hammer circular column portion having a second hammer circular column portion diameter, said second hammer circular column portion diameter being equal to said semi-circular protrusion diameter, said semi-circular column protrusion being integrally connected with said second hammer circular column portion, at least a portion of said second hammer circular column portion being arranged in said second hammer cylindrical portion receiving space, at least a portion of said second hammer semi-circular column protrusion being arranged in said semi-circular column protrusion receiving space;

a first rotor comprising a first rotor engagement claw;

a second rotor comprising a second rotor engagement claw;

a means for moving said first rotor and said second rotor such that said first rotor engagement claw rotor engages said first weight hammer and moves said first weight hammer from a first hammer original position to a first hammer raised position and such that said second rotor engagement claw rotor engages said second weight hammer and moves said second weight hammer from an original second weight hammer position to a raised second weight hammer position when said first weight hammer is released via said first rotor engagement claw rotor, whereby said first hammer weight and said second hammer weight move relative to each other.

6. A drilling apparatus in accordance with claim 5, wherein said hammer apparatus further comprises a first spring and a second spring, said first weight hammer compressing said first spring with said first weight hammer in said first hammer raised position, said second weight hammer compressing said second spring with said second weight hammer in said second hammer raised position.

* * * * *